US010793485B2

(12) United States Patent
Quintana Angulo et al.

(10) Patent No.: US 10,793,485 B2
(45) Date of Patent: Oct. 6, 2020

(54) WATER-BASED EXPLOSIVE SUSPENSION

(71) Applicant: MaxamCorp Holding, S.L., Madrid (ES)

(72) Inventors: José Ramón Quintana Angulo, Galdakao (ES); Arturo Carranza Vítores, Galdakao (ES)

(73) Assignee: MAXAMCORP HOLDING, S.L., Madrid (ES)

( * ) Notice: Subject to any disclaimer, the term of this patent is extended or adjusted under 35 U.S.C. 154(b) by 178 days.

(21) Appl. No.: 15/550,315

(22) PCT Filed: Feb. 9, 2016

(86) PCT No.: PCT/EP2016/052692
§ 371 (c)(1),
(2) Date: Aug. 10, 2017

(87) PCT Pub. No.: WO2016/128382
PCT Pub. Date: Aug. 18, 2016

(65) Prior Publication Data

US 2018/0029950 A1 Feb. 1, 2018

(30) Foreign Application Priority Data

Feb. 10, 2015 (EP) ..... 15382045

(51) Int. Cl.
*C06B 31/00* (2006.01)
*C06B 23/00* (2006.01)
(Continued)

(52) U.S. Cl.
CPC ..... *C06B 23/001* (2013.01); *C06B 47/14* (2013.01)

(58) Field of Classification Search
USPC ..... 149/45, 46, 61, 109.4, 109.6
See application file for complete search history.

(56) References Cited

U.S. PATENT DOCUMENTS 3,303,738 A 2/1967 Clay et al.
3,400,026 A 9/1968 Fearnow
(Continued)

FOREIGN PATENT DOCUMENTS

EP 0256669 2/1988
RU 2203258 C2 4/2003
(Continued)

OTHER PUBLICATIONS

Madadevan, E. G., "Ammonium Nitrate Explosives for Civil Applications: Slurries, Emulsions and Ammonium Nitrate Fuel Oils", © 2013 Wiley-VCH Verlag, GmbH & Co. KGaA, Weinheim, Germany., (2013), 56 pgs.
(Continued)

*Primary Examiner* — James E McDonough
(74) *Attorney, Agent, or Firm* — Tristian A. Fuierer; Olive Law Group, PLLC

(57) ABSTRACT

The present invention relates to a water-based non-sensitized matrix or explosive suspension which itself has a rheological behavior such that it allows mechanically loading upward boreholes. This suspension behaves like a viscous liquid when it is forced to flow due to the action of a loading pump, and, however, has the characteristics of a soft solid when it is on standby once inside the borehole. The composition essentially consists of an aqueous solution of oxidizing salts and optionally water-soluble fuels and/or sensitizers, and one or more water-soluble polymers conferring the desired rheological characteristics. Particles of oxidizing salts with a grain size such that they enhance the rheological behavior characteristic of the suspension are dispersed in this aqueous solution.

17 Claims, 2 Drawing Sheets

(51) Int. Cl.

| | |
|---|---|
| ***C06B 47/14*** | (2006.01) |
| *C06B 31/28* | (2006.01) |
| *C06B 31/02* | (2006.01) |
| *D03D 23/00* | (2006.01) |
| *D03D 43/00* | (2006.01) |

(56) References Cited

U.S. PATENT DOCUMENTS

| | | | | |
|---|---|---|---|---|
| 3,791,255 | A | 2/1974 | Fox et al. | |
| 4,404,051 | A * | 9/1983 | Kalu | C06B 47/14 149/37 |
| 4,615,752 | A | 10/1986 | Miller | |
| 4,829,902 | A | 5/1989 | Sharpe et al. | |
| 6,761,781 | B1 | 7/2004 | Lawrence et al. | |
| 2003/0140995 | A1 * | 7/2003 | O'Hara | C06B 47/145 149/46 |
| 2005/0067075 | A1 * | 3/2005 | Legario | C06B 31/285 149/46 |
| 2006/0243362 | A1 * | 11/2006 | Houston | C06B 23/001 149/46 |

FOREIGN PATENT DOCUMENTS

| | | | |
|---|---|---|---|
| RU | 2211824 | C1 | 9/2003 |
| WO | WO-1988000952 | | 2/1988 |
| WO | WO-1996013698 | | 5/1996 |
| WO | WO-1998051645 | | 11/1998 |
| WO | WO-1999021809 | | 5/1999 |
| WO | WO-2008127134 | | 10/2008 |
| WO | WO-2016128382 | | 8/2016 |

OTHER PUBLICATIONS

Choppe, Emilie, et al., "Rheology of xanthan solutions as a function of temperature, concentration and ionic strength", Carbohydrate Polymers, 82(4), (Nov. 11, 2010), 1228-1235.

"International Application No. PCT/EP2016/052692, International Search Report and Written Opinion dated May 13, 2016", (May 13, 2016), 15 pgs.

Dobrynin, A. A., "Explosive Agents, Chemistry, Formulations", Safety, M., Publishing House of Zhukovsky's Academy, (2014), 267-270.

* cited by examiner

WATER-BASED EXPLOSIVE SUSPENSION

PRIORITY CLAIM TO RELATED APPLICATIONS

This application is a U.S. national stage application filed under 35 U.S.C. § 371 from International Application Serial No. PCT/EP2016/052692, which was filed 9 Feb. 2016, and published as WO2016/128382 on 18 Aug. 2016, and which claims priority to European Application No. 15382045.1, filed 10 Feb. 2015, which applications and publication are incorporated by reference as if reproduced herein and made a part hereof in their entirety, and the benefit of priority of each of which is claimed herein.

FIELD OF THE INVENTION

The present invention is comprised in the category of civil explosives for use in mining and civil works. More specifically, it relates to a water-based explosive mixture manufactured for being loaded especially in upward boreholes. This explosive mixture is of suspension/gel type and contains one or more water-soluble polymers conferring the mixture with special rheological properties which allow loading same in said upward boreholes.

BACKGROUND OF THE INVENTION

The use of explosives in civil works and mining is so widespread that developing said activities without using explosives would be unthinkable today. When explosives are used for breaking rocks by means of blasting, the method consists of making spaced boreholes, filling the boreholes with cartridged or bulk explosives and subsequently detonating the explosives.

The market has evolved from using generally detonator-sensitive cartridged products to far less sensitive bulk products which must be initiated with a primer. The bulk explosive is most commonly used. Bulk explosives can be of the ANFO type (mixture of ammonium nitrate with a liquid hydrocarbon) or water-based explosives. Water-based explosives can be of two types, i.e., suspension/hydrogels and emulsions.

Explosive compositions in water-in-oil type emulsion are intimate mixtures of two immiscible liquids that are formed by the following components: a) a discontinuous aqueous phase in the form of small droplets consisting of an oversaturated or concentrated solution of oxidizing salts, b) an organic phase immiscible with the aqueous phase having therein the droplets of the aqueous phase, and c) an emulsifier or a mixture of emulsifiers keeping the droplets of the aqueous phase dispersed in the oily phase for a certain time period.

Explosive suspensions/hydrogels consist essentially of a viscous and saturated aqueous solution of oxidizing and reducing salts and a polymer, having dispersed therein oxidizing solid particles and, in some cases, fuels. An explosive or matrix (i.e. non-sensitized) suspension would be a fluid mixture as described above which is capable of being pumped and is water-miscible. An explosive hydrogel is a soft solid formed from a suspension as described above by means of adding a cross-linking agent causing polymer reticulation.

One of the most frequently used methods for filling boreholes with water-based bulk explosives is pumping the explosives by means of a pump driving the product along a hollow and flexible duct to the bottom of the boreholes. To facilitate the operation of pumping the explosive from a deposit to the bottom of the borehole through a duct, which is usually a hose, the viscosity of the explosive must be low enough so that pressure drop arising in the hose is not too high. If the pumping pressure is too high, the pump may not have the necessary capacity or recirculation may occur within the pump. Excessive pumping pressure reduces safety margins in the operation of loading the explosive in the boreholes. In addition, the explosive must have a moderately high viscosity so that when loading boreholes, particularly downward boreholes, the explosive does not flow through possible cracks on the ground. In the case of loading upward boreholes from the top-end of the borehole (downwards), the viscosity of the explosive must be greater still to aid the explosive to self-sustain, preventing force of gravity from causing the explosive to flow freely and the borehole to empty.

A frequently used method for reducing pressure when pumping the product into the borehole consists of injecting a lubricating liquid between the product and the inner surface of the loading hose or duct. This lubricating liquid is usually water or an aqueous solution.

Upward boreholes are used in underground mining and they are understood as those boreholes having an inclination comprised between more than 0° and 90° with respect to the horizontal. Loading such boreholes presents great difficulties and the present invention relates to loading downwards said boreholes from the top-end of the borehole. The difficulty lies in the fact that the explosive must have a very high viscosity or consistency to be able to self-sustain in the borehole. However, a highly viscous product would generate too much pressure drop in the loading hose, preventing the loading pump from working in suitable conditions. In addition, a highly viscous product would greatly complicate the logistics thereof. In general, it must be borne in mind that the matrix or explosive suspension is manufactured in an industrial site and then transported to the site of use in either metal or plastic containers of various capacities (cisterns, GRGs, . . . ). In this process, the product can be pumped several times in order to transfer it. In general, this problem has been addressed by implementing processes allowing the matrix or explosive suspension to have a low viscosity until it exits the loading pump and causing a change in product viscosity so that it is very high when introduced in the borehole.

In the case of matrix or explosive emulsions, a frequently used solution consists of placing one or more shear generating devices after the loading pump, either at the end of the loading hose (U.S. Pat. No. 4,615,752) or before it (WO 96/13698). Shearing action on the emulsion causes droplets thereof to split into other smaller droplets, significantly increasing droplet surface and reducing the thickness of the continuous phase existing between the droplets. This reduction in thickness of the continuous phase between the droplets and the fact that the discontinuous phase has a percentage greater than 90% in the explosive emulsions leads to considerable increase in the viscosity of the emulsion as it goes through the shearing devices. The emulsion which is deposited on or projected to the bottom of the borehole therefore has a high consistency.

In the case of suspension-type matrices or explosives, patent U.S. Pat. No. 3,303,738 describes a process for manufacturing a suspension/hydrogel in situ, where the components are transported separately to the loading site and the components including a thickening agent are mixed before being loaded. Due to the time it takes for the thickening agent to develop the required viscosity, pumping is performed with a product having a very low viscosity and viscosity increases in the borehole to the point of preventing sedimentation of suspension solid particles. However, this method is not applicable for loading upward boreholes from the top-end of the borehole because the increase in viscosity is too slow, such that the product still has a very low viscosity at the outlet of the hose preventing it from being retained in the borehole.

BRIEF DESCRIPTION OF THE INVENTION

The present invention relates to a water-based matrix (i.e. non-sensitized) or explosive suspension which itself has a rheological behavior such that it solves the difficulties existing in loading upward boreholes from the top-end. This suspension behaves like a low viscosity liquid when it is forced to flow due to the action of a loading pump, and, however, has the characteristics of a soft solid when it is on standby once inside the borehole. The viscoelastic properties of this suspension change drastically with the shear rate. This suspension comprises or essentially consists of an aqueous solution of one or more oxidizing salts, for example, one or more inorganic oxidizing nitrates, and optionally one or more water-soluble fuels and/or sensitizers, and one or more water-soluble polymers which can bring about a shear-thinning-type behavior, such as one or more polymers of the galactomannan type or xanthan gums, enhancing the desired rheological characteristics. Particles of one or more oxidizing salts, for example, inorganic oxidizing nitrates with a grain size and in a percentage such that they enhance the specific rheological behavior of this suspension, are dispersed in this solution. Once introduced in the borehole, the suspension can transform into explosive by means of generating gas bubbles by means of a chemical gasification process.

The present invention also comprises an explosive suspension originating from introducing air bubbles, or porous or hollow particles in the non-sensitized matrix suspension described in the preceding paragraph before pumping in into the borehole. The present invention also comprises an explosive suspension originating from introducing gas bubbles in the non-sensitized matrix suspension described in the preceding paragraph when the suspension is pumped into the borehole.

Once the matrix or explosive suspension is loaded in the borehole, it is also possible to promote the reticulation of the polymers existing in the suspension in order to increase the explosive resistance to water.

DETAILED DESCRIPTION OF THE INVENTION

Figure 1:
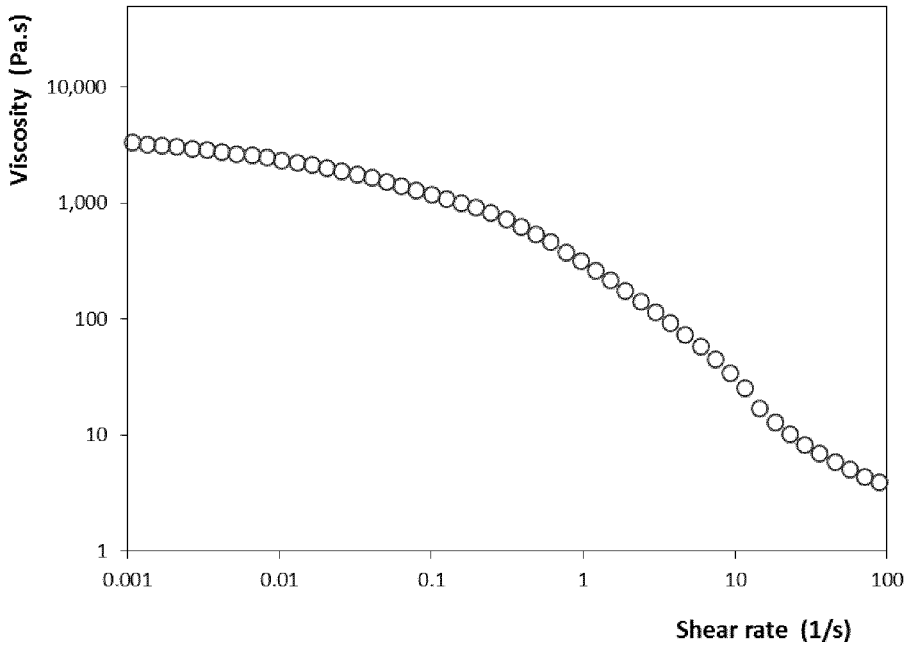
FIGS. 1 and 3 respectively show the viscosity as a function of the shear rate for a standard suspension for use in open pit mines and a suspension according to the present invention.

The terms "matrix" or "non-sensitized matrix" are known for the skilled person in the field of the invention and refer to a non-explosive composition, particularly a non-explosive suspension in the context of the present invention, which is aimed to be sensitized (i.e. converted into explosive). Generally, a non-sensitized matrix suspension may be classified as an oxidizer 5.1.

The main objective of this invention is to provide a water-based non-sensitized matrix or explosive suspension characterized by being a non-Newtonian fluid with a significant shear-thinning-type rheological behavior. Such behavior is characterized by a decrease in viscosity as the shear rate increases. When it is on standby inside the borehole, the suspension thus has a viscosity so high which allows it to self-sustain in the upward borehole without flowing downwards due to the action of gravity. In addition, when the suspension is circulated through the loading duct to the borehole due to the action of a pump, the high shear rate dramatically reduces suspension viscosity such that pressure drop while pumping is kept at reasonable values.

Therefore, in one aspect the invention relates to a matrix or explosive suspension, hereinafter "suspension of the invention", consisting of a water-based suspension comprising a liquid phase where a solid phase is suspended, which is characterized by being a non-Newtonian fluid with a significant shear-thinning-type rheological behavior, which behavior is characterized by a decrease in viscosity as the shear rate increases, as described above in the preceding paragraph. The liquid phase is an aqueous solution of at least one oxidizing salt, and at least one water-soluble polymer which can impart a significant shear-thinning-type rheological behavior to the suspension. Optionally, said aqueous solution can also contain at least one water-soluble fuel material and/or sensitizer. The solid phase comprises small-sized particles of at least one oxidizing salt, and optionally, particles of at least one fuel can also be present. More specifically, the suspension of the invention formed by a solid phase and an aqueous liquid phase is characterized in that it has a composition characterized in that:

a) the solid phase is present in a percentage comprised between 35% and 55% by weight with respect to the total weight of the suspension, b) the solid phase comprises particles of an oxidizing salt with an average grain size comprised between 100 μm and 500 μm, and c) the liquid phase is an aqueous solution comprising at least one oxidizing salt and at least one water-soluble polymer which can impart a significant shear-thinning-type rheological behavior to the suspension, and in that it has a specific rheological behavior characterized by:

a) a viscosity having a value equal to or greater than 10,000 Pa·s for a shear rate of 0.001 $s^{-1}$ and equal to or less than 10 Pa·s for a shear rate of 100 $s^{-1}$, and b) a yield stress equal to or greater than 1 Pa.

The suspension viscosity increases as the suspension solid content increases and as the average suspended solid particle size decreases. Taking these dependencies into account, limits of the percentage of solids and of the average suspended particle size have been chosen allowing the suspensions to have viscosity values such that they facilitate loading the borehole by means of pumping and at the same time facilitating suspension self-sustaining capacity in upward boreholes.

It is particularly preferred that said suspension of the invention, either non-sensitized matrix or explosive suspension, has a viscosity greater than 10,000 Pa·s, or, more preferably greater than 20,000 Pa·s, for a shear rate of 0.001 $s^{-1}$, and less than 10 Pa·s, or more preferably less than 5

Pa·s, for a shear rate of 100 $s^{-1}$. Unless otherwise indicated, the term "viscosity" as it is used herein refers to "dynamic viscosity".

In a particular, although non-limiting, embodiment of this invention, said suspension of the invention, either non-sensitized matrix or explosive suspension, has in a shear oscillatory test in the linear viscoelasticity range, elastic modulus values, G', that are always greater than the viscous modulus values, G", for all angular frequencies comprised between 0.01 and 100 rad/s, and preferably between 0.005 and 500 rad/s, indicating a predominantly elastic behavior.

In order to increase the self-sustaining capacity of the suspension provided in detail in the invention, this suspension has a significant yield stress. In other words, the force that must be applied on the suspension must have a value greater than the indicated yield stress, so that the suspension starts to flow. In a particular embodiment, said suspension has a yield stress greater than 1 Pa.

Ammonium, alkaline metal or alkaline earth metal nitrates, chlorates and perchlorates and mixtures thereof can be used as oxidizing salts. Non-limiting illustrative examples of said salts include, among others, ammonium, sodium, potassium, lithium, magnesium or calcium nitrates, chlorates and perchlorates. The total concentration of oxidizing salts can usually vary between 50% and 90% by weight of the suspension of the invention, preferably between 60% and 80%. The person skilled in the art will understand that said oxidizing salts will be in the form of an aqueous solution, being part of the liquid phase of the suspension of the invention, and in the form of particles, with an average grain size comprised between 100 μm and 500 μm, being part of the solid phase of the suspension of the invention.

Natural or synthetic products, for example, natural products derived from seeds or microorganisms, derived from cellulose or synthetic polymers and mixtures thereof, can be used as water-soluble polymers which can impart a significant shear-thinning-type rheological behavior to the suspension. More specifically, these polymers can be, among others, galactomannans, such as guar gum, xanthan gum or carboxymethyl cellulose and the derivatives thereof. Some of these polymers can be reticulated in order to increase the end explosive resistance to water. The total concentration of dissolved polymer can usually vary between 0.4% and 5% by weight of the suspension of the invention, preferably between 0.6% and 3%.

If desired, the suspension of the invention can contain one or more fuel materials. The fuel materials optionally present in the suspension can be liquids or solids, for example, organic compounds belonging to the group formed by saturated or unsaturated aliphatic hydrocarbons and aromatic hydrocarbons, oils, petroleum derivatives, or of plant origin such as starch, flour, sawdust, molasses and sugars, or also finely divided metal fuels such as aluminum, silicon or ferrosilicon. The suspension of the invention can contain, optionally, mixtures of the mentioned fuel materials. In general, the total concentration of fuel material in the suspension of the invention, if it contains fuel materials, can vary between 1% and 20% by weight of the suspension, preferably between 3% and 10%. The person skilled in the art will understand that, if the suspension of the invention contains one or more liquid or dissolved (in water) fuels they will be part of the liquid phase of the suspension; likewise, said person skilled in the art will understand that, if the suspension of the invention contains one or more solid fuels in the form of particles, they will be part of the solid phase of the suspension. According to the present invention, the suspension of the invention can contain (i) one or more fuels in the liquid phase, (ii) particles of one or more fuels in the solid phase, or (iii) one or more fuels in the liquid phase and particles of one or more fuels in the solid phase.

If desired, the suspension of the invention contains one or more sensitizers. Advantageously, said sensitizers are water-soluble and are part of the liquid phase. Therefore, in a preferred and particular embodiment, the optional sensitizers can be those commonly used in manufacturing such water-based explosives. In a particular embodiment, said sensitizers can be alkylamine nitrates, such as for example, monomethylamine nitrate, dimethylamine nitrate, etc., or alkanolamine nitrates, such as for example, ethanolamine nitrate, diethanolamine nitrate, triethanolamine nitrate, etc., as well as nitrates of other water-soluble amines such as hexamine, diethylenetriamine, ethylenediamine and mixtures thereof. The total concentration of sensitizers in the suspension of the invention, if it contains same, can usually vary between 0.5% and 40% by weight of the suspension, preferably between 2% and 30%.

The aqueous suspension according to this invention can be a non-sensitized matrix suspension, i.e., non-explosive, before being pumped into the borehole and converted into explosive in the borehole due to the chemical generation of gas bubbles therein, the density thereof being reduced. To that end, a gas bubble generating agent is mixed in the process of loading the borehole. Peroxides, such as for example, hydrogen peroxide, etc., carbonates, such as for example sodium bicarbonate, etc., nitrous acid or salts thereof, such as for example, sodium nitrite, etc., nitrosamines, such as for example N,N-dinitroso-pentamethylentetramine, etc., and diisocyanates can be used as a gas bubble generating agent. The suspension of the invention can also incorporate, in this case, the catalyst for chemical gas bubble generation reaction, for example, thiourea or thiocyanate when the gas bubble generating agent is a nitrite or nitrous acid salt. In general, the gas bubble generating agent can be present in the suspension of the invention which is loaded in the borehole in a concentration comprised between 0.01% and 3% by weight, preferably between 0.05% and 1% by weight with respect to the total weight of the suspension of the invention. The gas bubble generating agent is transported to the sensibilization site "in situ" in a suitable container such as a deposit. In a preferred embodiment the gas bubble generating agent is mixed with the suspension at the end of the hose.

Likewise, according to the present invention, the aqueous suspension according to this invention can be an explosive suspension before being pumped into the borehole. The non-sensitized matrix suspension can be converted into an explosive suspension by means of adding porous or hollow solid particles, or by means of introducing air bubbles by means of mechanical stirring, aided by the addition of an air bubble stabilizing agent. The conversion of the non-sensitized suspension into an explosive suspension can be carried out either in an industrial site or on the pumping unit. This pumping unit would have a suitable container for porous or hollow solid particles and a mixing element to incorporate these particles into the non-sensitized suspension, or a suitable container for an air bubble stabilizing agent and a stirring element to incorporate air bubbles and the stabilizing agent into the non-sensitized suspension.

Hollow glass microspheres, hollow plastic microspheres, extendospheres or perlite can be used as porous or hollow solid particles. The total concentration of these particles in the explosive suspension, if it contains same, can usually vary between 0.5% and 10% by weight of the explosive suspension, preferably between 1% and 7%.

Solutions or dispersions of surfactants, such as fatty acid amine derivatives, such as for example, lauryl amine acetate, etc., proteins, such as for example, egg albumin, lactoalbumin, collagen, soy protein, guar protein, or modified guar gum of the hydroxypropyl-guar type, etc., or mixtures of said products can be used as a gas/air bubble stabilizing agent. The concentration of the gas/air bubble stabilizing agent can vary between 0.01% and 5% by weight with respect to the explosive suspension which is loaded in the borehole, preferably between 0.1% and 2% by weight.

If the end explosive composition inside the borehole is to be reticulated, at least one cross-linking agent can be incorporated. Antimony compounds such as potassium pyroantimonate, antimony and potassium tartrate, etc., or chromium compounds such chromic acid, sodium or potassium dichromate, etc., or zirconium compounds such as zirconium sulfate or zirconium diisopropylamine-lactate, etc., or titanium compounds such as triethanolamine titanium chelate, etc., or aluminum compounds such as aluminum sulfate, etc., can be used as a cross-linking agent. The person skilled in the art will understand that the cross-linking agent suitable for cross-linking the polymer chains of the water-soluble polymer which can be cross-linked will be chosen. The cross-linking agent can usually be present in the suspension which is loaded in the borehole in a concentration comprised between 0.01% and 5% by weight, preferably between 0.01% and 2% by weight with respect to the total weight of said mixture. In a preferred embodiment, the cross-linking agent is mixed with the suspension at the end of the hose.

In a particular embodiment, the suspension of the invention is an explosive suspension having a density, in normal conditions of use, comprised between 0.5 and 1.2 g/cm$^3$, preferably between 0.8 and 1.1 g/cm$^3$.

In a particular embodiment, the suspension of the invention is a matrix or explosive suspension formed by a solid phase and an aqueous liquid phase the composition of which is characterized in that:

a) the solid phase is present in a percentage comprised between 35% and 55% by weight with respect to the total weight, b) the solid phase comprises particles of an inorganic oxidizing salt selected from the group consisting of an ammonium or alkaline metal or alkaline earth metal nitrate, chlorate or perchlorate, and mixtures thereof, with an average grain size comprised between 100 and 500 μm, and c) the liquid phase is an aqueous solution containing, (i) at least one inorganic oxidizing salt selected from the group consisting of an ammonium or alkaline metal or alkaline earth metal nitrate, chlorate or perchlorate, and mixtures thereof; (ii) at least one water-soluble sensitizer or fuel selected from the group consisting of an alkylamine nitrate, an alkanolamine nitrate, a nitrate of a water-soluble amine selected from hexamine, diethylenetriamine and ethylenediamine, and mixtures thereof; and (iii) at least one water-soluble polymer which can impart a significant shear-thinning-type rheological behavior to the suspension selected from a natural or synthetic product, and mixtures thereof;

and has a specific rheological behavior characterized by:

a) a viscosity having a value equal to or greater than 10,000 Pa·s for a shear rate of 0.001 s$^{-1}$ and equal to or less than 10 Pa·s for a shear rate of 100 s$^{-1}$, and b) a yield stress equal to or greater than 1 Pa.

In a particular embodiment, the suspension of the invention is a matrix or explosive suspension formed by a solid phase and an aqueous liquid phase the composition of which is characterized in that:

a) the solid phase is present in a percentage comprised between 35% and 55% by weight with respect to the total weight, b) the solid phase comprises particles of an inorganic oxidizing salt, such as an ammonium or alkaline metal or alkaline earth metal nitrate, chlorate or perchlorate, or mixtures thereof, preferably ammonium nitrate, with an average grain size comprised between 100 and 500 μm, and c) the liquid phase is an aqueous solution containing at least one inorganic oxidizing salt, such as an ammonium or alkaline metal or alkaline earth metal nitrate, chlorate or perchlorate, or mixtures thereof, preferably an inorganic nitrate, more preferably ammonium nitrate; at least one water-soluble sensitizer, such as an alkylamine nitrate, an alkanolamine nitrate, a nitrate of other water-soluble amines such as hexamine, diethylenetriamine, ethylenediamine, etc., or mixtures thereof, preferably an amine nitrate, more preferably, monomethylamine nitrate; and at least one water-soluble polymer which can impart a significant shear-thinning-type rheological behavior to the suspension, such as a natural or synthetic product, for example, a natural product derived from seeds or from microorganisms, a cellulose derivative, a synthetic polymer, or mixtures thereof, preferably a galactomannan-type gum, such as guar gum, xanthan gum, etc., or carboxymethyl cellulose or derivatives thereof, more preferably a polymer selected from the group consisting of a galactomannan-type gum, a xanthan gum and mixtures thereof;

and has a specific rheological behavior characterized by:

a) a viscosity having a value equal to or greater than 10,000 Pa·s, preferably equal to or greater than 20,000 Pa·s, for a shear rate of 0.001 s$^{-1}$ and equal to or less than 10 Pa·s for a shear rate of 100 s$^{-1}$, and b) a yied stress equal to or greater than 1 Pa.

In another particular embodiment, the suspension of the invention is a matrix or explosive suspension formed by a solid phase and an aqueous liquid phase the composition of which is characterized in that:

a) the solid phase is present in a percentage comprised between 35% and 55% by weight with respect to the total weight, b) the solid phase comprises particles of ammonium nitrate, with an average grain size comprised between 100 and 500 μm, and c) the liquid phase is an aqueous solution containing (i) at least one inorganic nitrate, (ii) at least one amine nitrate selected from an alkylamine nitrate, an alkanolamine nitrate, a hexamine, diethylenetriamine or ethylenediamine nitrate, and mixtures thereof, and (iii) at least one water-soluble polymer which can impart a significant shear-thinning-type rheological behavior to the suspension selected from the group consisting of a galactomannan-type gum, a xanthan gum and mixtures thereof;

and has a specific rheological behavior characterized by:

a) a viscosity having a value equal to or greater than 10,000 Pa·s, preferably equal to or greater than 20,000 Pa·s, for a shear rate of 0.001 s$^{-1}$ and equal to or less than 10 Pa·s for a shear rate of 100 s$^{-1}$, and b) a yield stress equal to or greater than 1 Pa.

The suspension of the invention, in any of its alternatives (explosive or non-sensitized matrix suspension) can be obtained by conventional methods for obtaining water-based suspensions by means of mixing different components in the suitable amounts and under suitable conditions.

In a particular embodiment, when the suspension of the invention is a non-sensitized matrix suspension, this can be easily obtained by means of a method which comprises mixing a liquid phase comprising at least one oxidizing salt, and at least one water-soluble polymer which can impart a significant shear-thinning-type rheological behavior to the suspension, with a solid phase comprising particles of at least one oxidizing salt. Alternatively, when the suspension of the invention is a non-sensitized matrix suspension, this can be easily obtained by means of a method which comprises mixing a liquid phase comprising at least one oxidizing salt, with a solid phase comprising particles of at least one oxidizing salt, and dissolving at least one water-soluble polymer which can impart a significant shear-thinning-type rheological behavior to the suspension. In a particular embodiment of said method, said liquid phase further comprises at least one water-soluble fuel material and/or sensitizer; and said solid phase further may comprise particles of at least one fuel. The characteristics of said oxidizing salt, water-soluble polymer which can impart a significant shear-thinning-type rheological behavior to the suspension, fuel and sensitizer as well as the concentrations in which they can be present in the suspension have already been previously mentioned and are incorporated herein by reference.

In another particular embodiment, the non-sensitized suspension can be converted into explosive in the borehole, this can be easily obtained by means of a method which comprises preparing the matrix suspension and mixing said suspension, when the borehole is being loaded, with a gas bubble generating agent and, optionally with a cross-linking agent, in the suitable proportions, for obtaining the required density and, optionally resistance to water. The characteristics of said gas bubble generating agent and cross-linking agent as well as the concentrations in which they can be present in the explosive suspension have already been previously mentioned and are incorporated herein by reference. In a particular embodiment, said gas bubble generating agent is a nitrous acid salt; in another particular embodiment, said cross-linking agent is an inorganic compound containing antimony, for example, antimony and potassium tartrate, etc.; and, in another particular embodiment, said explosive suspension has a density, in normal conditions of use, comprised between 0.5 and 1.2 g/cm$^3$, preferably between 0.8 and 1.1 g/cm$^3$.

In another particular embodiment, the suspension of the invention is an explosive suspension, which can be easily obtained by means of a method which comprises preparing the non-sensitized matrix suspension and mixing said suspension, in an industrial site or on the pumping unit before the suspension is pumped into the borehole, with porous or hollow solid particles, in the suitable proportions, for obtaining the required density and, optionally mixing the sensitized suspension with a cross-linking agent, in the suitable proportions, when it is pumped into the borehole, for obtaining the required resistance to water. The characteristics of said porous or hollow solid particles and cross-linking agent as well as the concentrations in which they can be present in the explosive suspension have already been previously mentioned and are incorporated herein by reference. In a particular embodiment, said porous or hollow solid particles are hollow glass microspheres, hollow plastic microspheres, extendospheres or perlite; in another particular embodiment, said cross-linking agent is an inorganic compound containing antimony, for example, antimony and potassium tartrate, etc.; and, in another particular embodiment, said explosive suspension has a density, in normal conditions of use, comprised between 0.5 and 1.2 g/cm$^3$, preferably between 0.8 and 1.1 g/cm$^3$.

In another particular embodiment, the suspension of the invention is an explosive suspension, which can be easily obtained by means of a method which comprises preparing the non-sensitized suspension and introducing air bubbles into said suspension, in an industrial site or on the pumping unit before the suspension is pumped into the borehole, by means of mechanical stirring and aided by the addition of an air bubble stabilizing agent, in the suitable proportions, for obtaining the required density and, optionally mixing the sensitized suspension with a cross-linking agent, in the suitable proportions, when it is pumped into the borehole, for obtaining the required resistance to water. The characteristics of said air bubble stabilizing agent and cross-linking agent as well as the concentrations in which they can be present in the explosive suspension have already been previously mentioned and are incorporated herein by reference. In a particular embodiment, said air bubble stabilizing agent is a solution or dispersion of one or more surfactants, one or more proteins, or mixtures of both type of products; in another particular embodiment, said cross-linking agent is an inorganic compound containing antimony, for example, antimony and potassium tartrate, etc.; and, in another particular embodiment, said explosive suspension has a density, in normal conditions of use, comprised between 0.5 and 1.2 g/cm$^3$, preferably between 0.8 and 1.1 g/cm$^3$.

The invention is illustrated by means of the following two comparative examples which are not limiting of the scope of the invention in any way.

Example 1 (Comparative)—State of the Art

This example describes the rheological behavior of a standard suspension which can be used for loading downward boreholes in open-pit mines or quarries and the composition of which is described in Table 1. The solid particles of ammonium nitrate in the suspension had an average grain size of 600 μm and their percentage with respect to the suspension was 42% by weight at 20° C.

TABLE 1

| Matrix (i.e. non-sensitized) suspension composition | |
|---|---|
| Component | % |
| Water | 14.8 |
| Ammonium nitrate | 70.8 |
| Monomethylamine nitrate | 13.5 |
| Guar gum | 0.7 |
| Thiourea | 0.2 |

Variation in viscosity as a function of shear rate is shown in FIG. 1. As can be seen in the graph, this suspension has a viscosity of about 3.9 Pa·s at a shear rate of 100 s$^{-1}$ and about 3,300 Pa·s at a shear rate of 0.001 s$^{-1}$.

Figure 2:
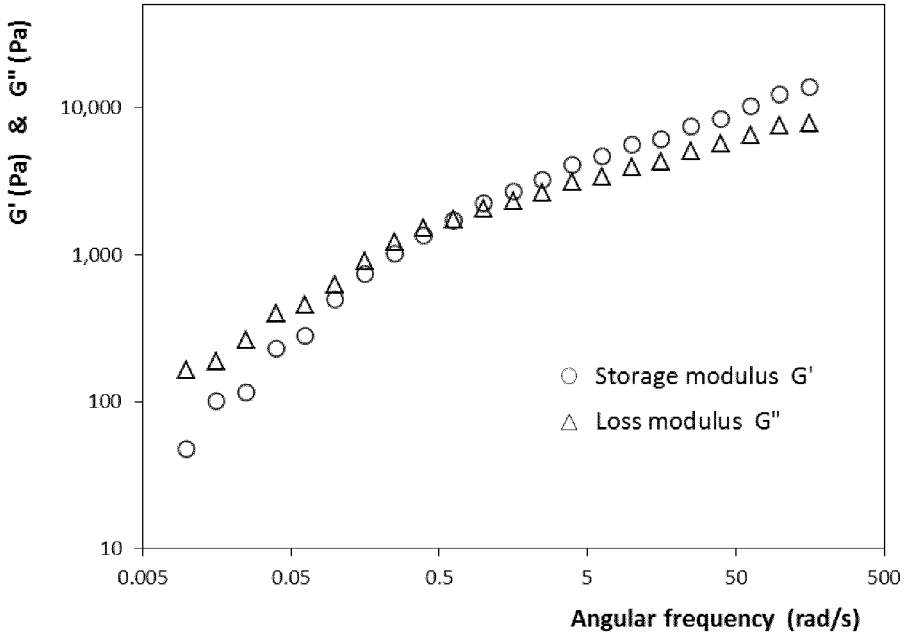
FIGS. 2 and 4 respectively show the elastic modulus, G', and viscous modulus, G", as a function of the oscillatory test frequency for a standard suspension for use in open-pit mines and a suspension according to the present invention.

The dependencies of elastic or storage modulus and of viscous or loss modulus as a function of frequency are shown in FIG. 2. As can be seen, the curves of the elastic modulus (elastic or storage modulus), G', and of the viscous modulus (viscous or loss modulus), G", intersect at an angular frequency of 0.6 rad/s, the viscous modulus being greater than the elastic modulus for lower frequencies. This behavior can be considered typical of a viscous liquid.

In addition, it can be considered that this suspension virtually has no yield stress since the calculated value was 0.5 Pa.

An attempt was made to fill this suspension into a plastic tube with the upper end sealed. The tube was 6 m in height and 100 mm in diameter with the upper end sealed. The method for filling the tube consisted of introducing a hose 25 mm in inner diameter to the upper end of the tube, and the suspension is then pumped at a flow rate of 50 kg/min. As the tube was being filled, the hose moved down uniformly. While filling the tube, part of the suspension came out of the tube. Once the hose reached the lower end of the tube, it was removed. The suspension existing in the tube dropped after a few seconds, the tube being empty.

Example 2—Invention

This example describes the rheological behavior of a typical suspension described in the present invention and designed for being able to be loaded in upward boreholes and the composition of which is described in Table 2. The solid particles of ammonium nitrate in the suspension had an average grain size of 400 μm and their percentage with respect to the suspension was 44% by weight at 20° C.

TABLE 2

Matrix (non-sensitized) suspension composition

| Component | % |
|---|---|
| Water | 13.8 |
| Ammonium nitrate | 71.0 |
| Monomethylamine nitrate | 13.0 |
| Guar gum | 1.0 |
| Xanthan gum | 1.0 |
| Thiourea | 0.2 |

Figure 3:
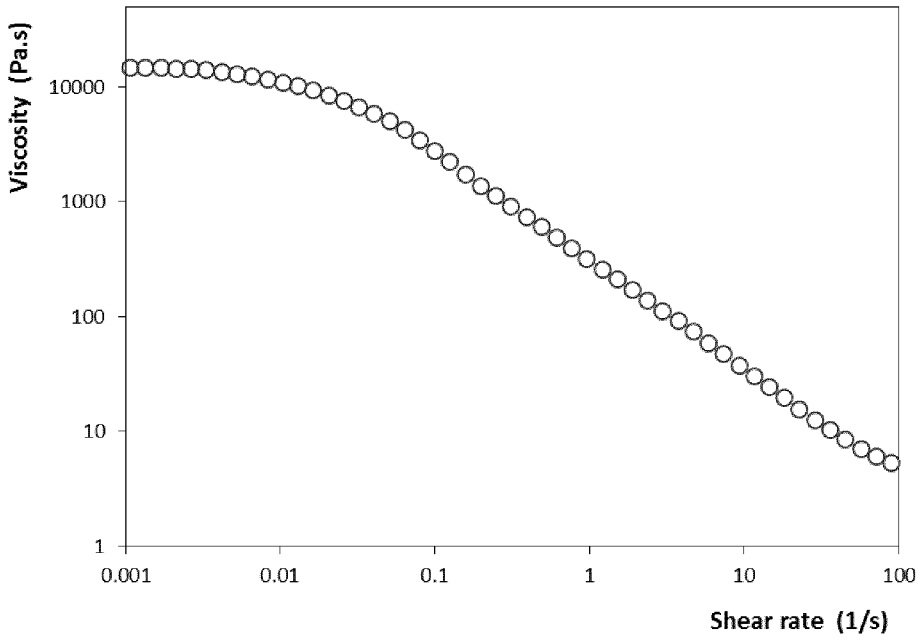

Variation in viscosity as a function of shear rate is shown in FIG. 3. As can be seen in the graph, this suspension has a viscosity of about 5.4 Pa·s at a shear rate of 100 $s^{-1}$ and about 14,700 Pa·s at a shear rate of 0.001 $s^{-1}$. By comparing the values obtained with those corresponding to Example 1, it can be deduced that both suspensions will have about the same ease for pumping as they both have similar viscosities at high shear rates. However, the suspension of Example 2 has a viscosity (14,700 Pa·s) considerably greater than that of Example 1 (3,300 Pa·s) so the greater ability thereof to self-sustain in the borehole is clearly deducible.

Figure 4:
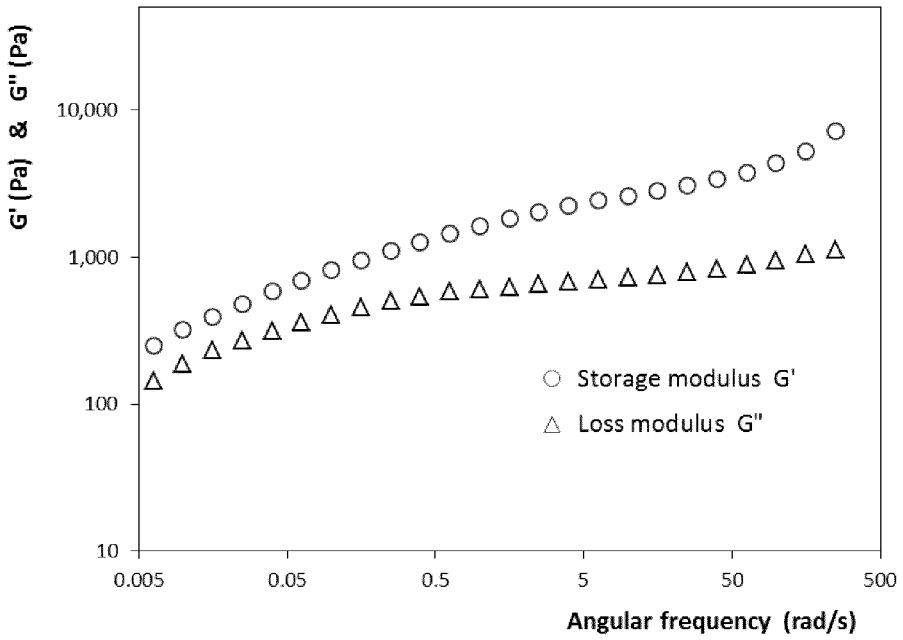

The dependencies of elastic or storage modulus and of viscous or loss modulus as a function of frequency are shown in FIG. 4. As can be seen, the elastic modulus is greater than the viscous modulus in the entire measured angular frequency interval. This behavior resembles that of a soft solid such as the case of a gel. In other words, this suspension has much less tendency to flow than the suspension of Example 1.

This suspension had a yield stress of 3.4 Pa, a value that is already significant.

The plastic tube described in Example 1 was filled with this suspension also using the same method. Product drop rarely occurred while loading the suspension. Once the hose reached the lower end of the tube, it was removed and the tube remained filled for more than 30 min.

The invention claimed is:

1. A non-sensitized matrix or explosive suspension formed by a solid phase and an aqueous liquid phase, wherein:

a) the solid phase is present in a percentage comprised between 35% and 55% by weight with respect to the total weight of the suspension, b) the solid phase comprises particles of an oxidizing salt with an average grain size comprised between 100 μm and 500 μm, and c) the liquid phase is an aqueous solution comprising at least one oxidizing salt, and at least one water-soluble polymer which can impart a significant shear-thinning-type rheological behavior to the suspension, and in that it has a specific rheological behavior characterized by:

a) a viscosity having a value equal to or greater than 10,000 Pa·s for a shear rate of 0.001 $s^{-1}$ and equal to or less than 10 Pa·s for a shear rate of 100 $s^{-1}$, and b) a yield stress equal to or greater than 1 Pa.

2. The suspension according to claim 1, wherein:

a) the solid phase is present in a percentage comprised between 35% and 55% by weight with respect to the total weight, b) the solid phase comprises particles of an inorganic oxidizing salt selected from the group consisting of an ammonium or alkaline metal or alkaline earth metal nitrate, chlorate or perchlorate, and mixtures thereof, with an average grain size comprised between 100 and 500 μm, and c) the liquid phase is an aqueous solution containing (i) at least one inorganic oxidizing salt selected from the group consisting of an ammonium or alkaline metal or alkaline earth metal nitrate, chlorate or perchlorate, and mixtures thereof; (ii) at least one water-soluble sensitizer or fuel selected from the group consisting of an alkylamine nitrate, an alkanolamine nitrate, a nitrate of a water-soluble amine selected from hexamine, diethylenetriamine and ethylenediamine, and mixtures thereof; and (iii) at least one water-soluble polymer which can impart a significant shear-thinning-type rheological behavior to the suspension selected from a natural or synthetic product, and mixtures thereof;

and having:

a) a viscosity having a value equal to or greater than 10,000 Pa·s for a shear rate of 0.001 $s^{-1}$ and equal to or less than 10 Pa·s for a shear rate of 100 $s^{-1}$, and b) a yield stress equal to or greater than 1 Pa.

3. The suspension according to claim 1, wherein:

a) the solid phase is present in a percentage comprised between 35% and 55% by weight with respect to the total weight, b) the solid phase comprises particles of ammonium nitrate, with an average grain size comprised between 100 and 500 μm, and c) the liquid phase is an aqueous solution containing (i) at least one inorganic nitrate, (ii) at least one amine nitrate selected from an alkylamine nitrate, an alkanolamine nitrate, a hexamine, diethylenetriamine or ethylenediamine nitrate, or mixtures thereof, and (iii) at least one water-soluble polymer which can impart a significant shear-thinning-type rheological behavior to the suspension selected from the group consisting of a galactomannan-type gum, a xanthan gum and mixtures thereof;

and having:

a) a viscosity having a value equal to or greater than 10,000, for a shear rate of 0.001 $s^{-1}$ and equal to or less than 10 Pa·s for a shear rate of 100 $s^{-1}$, and b) a yield stress equal to or greater than 1 Pa.

4. The suspension according to claim 1, wherein in oscillatory shear tests in a linear viscoelasticity range, an elastic modulus G' is greater than a viscous modulus G" in an angular frequency interval comprised between 0.01 rad/s and 100 rad/s.

5. A method for obtaining a non-sensitized matrix suspension formed by a solid phase and an aqueous liquid phase according to claim 1, which comprises mixing a liquid phase comprising at least one oxidizing salt, with a solid phase comprising particles of at least one oxidizing salt, and dissolving at least one water-soluble polymer which can impart a significant shear-thinning-type rheological behavior to the suspension.

6. The method according to claim 5, wherein said liquid phase further comprises at least one water-soluble fuel material and/or sensitizer; and said solid phase optionally further comprises particles of at least one fuel.

7. A method for obtaining an explosive suspension formed by a solid phase and an aqueous liquid phase according to claim 1, which comprises mixing the non-sensitized matrix suspension obtained according to the method of claim 5, with a gas bubble generating agent and optionally with a cross-linking agent, when the suspension is pumped into a borehole.

8. The method according to claim 7, wherein said gas bubble generating agent is a nitrous acid salt.

9. A method for obtaining an explosive suspension formed by a solid phase and an aqueous liquid phase according to claim 1, which comprises introducing air bubbles into the non-sensitized matrix suspension obtained according to the method of claim 5, by means of mechanical stirring and aided by the addition of an air bubble stabilizing agent, before the suspension is pumped into a borehole; and optionally mixing the explosive suspension with a cross-linking agent, when it is pumped into the borehole.

10. The method according to claim 9, wherein said air bubble stabilizing agent is a solution or dispersion of one or more surfactants, one or more proteins, or mixtures of both type of products.

11. A method for obtaining an explosive suspension formed by a solid phase and an aqueous liquid phase according to claim 1, which comprises mixing the non-sensitized matrix suspension obtained according to the method of claim 5, before the suspension is pumped into a borehole, with porous or hollow solid particles; and optionally mixing the explosive suspension with a cross-linking agent, when it is pumped into the borehole.

12. The method according to claim 11, wherein said porous or hollow solid particles are hollow glass microspheres, hollow plastic microspheres, extendospheres or perlite.

13. The method according to claim 7, wherein said cross-linking agent is an inorganic compound containing antimony.

14. The method according to claim 7, wherein said explosive suspension has a density comprised between 0.5 and 1.2 $g/cm^3$.

15. The suspension according to claim 3, having a viscosity having a value equal to or greater than 20,000 Pa·s for a shear rate of 0.001 $s^{-1}$ and equal to or less than 10 Pa·s for a shear rate of 100 $s^{-1}$.

16. The method according to claim 14, wherein said explosive suspension has a density comprised between 0.8 and 1.1 $g/cm^3$.

17. The suspension according to claim 1, wherein the total concentration of the at least one water-soluble polymer is between 0.4% and 5% by weight with respect to the total weight of the suspension.

* * * * *